United States Patent [19]

Sudo et al.

[11] 4,426,235

[45] Jan. 17, 1984

[54] COLD-ROLLED HIGH STRENGTH STEEL PLATE WITH COMPOSITE STEEL STRUCTURE OF HIGH $\bar{R}$-VALUE AND METHOD FOR PRODUCING SAME

[75] Inventors: Masatoshi Sudo, Kobe; Hiromi Hori, Akashi; Ichiro Tsukatani; Zenichi Shibata, both of Kobe, all of Japan

[73] Assignee: Kabushiki Kaisha Kobe Seiko Sho, Kobe, Japan

[21] Appl. No.: 342,841

[22] Filed: Jan. 26, 1982

[30] Foreign Application Priority Data

Jan. 26, 1981 [JP] Japan ..... 56-10539
Jan. 26, 1981 [JP] Japan ..... 56-10540

[51] Int. Cl.[3] ..... C21D 8/04

[52] U.S. Cl. ..... 148/12 C; 148/12 F; 148/12.4; 148/36

[58] Field of Search ..... 148/12 C, 12 F, 12.4, 148/134, 144, 36

[56] References Cited

U.S. PATENT DOCUMENTS

| | | | |
|---|---|---|---|
| Re. 28,878 | 6/1976 | Korchynsky et al. | 75/123 E |
| 3,340,102 | 9/1967 | Kulin et al. | 148/12.4 |
| 3,423,252 | 1/1969 | Grange | 148/12 R |
| 3,827,924 | 8/1974 | Takechi et al. | 148/12 F |
| 3,830,669 | 8/1974 | Matsuoka et al. | 148/12 F |
| 3,951,696 | 4/1976 | Gondo et al. | 148/12 F |
| 3,988,173 | 10/1976 | Kawano | 148/12 C |
| 3,988,174 | 10/1976 | Kawano | 148/12 C |
| 4,033,789 | 7/1977 | Hamburg et al. | 148/12 F |
| 4,050,959 | 9/1977 | Nakaoka et al. | 148/12.3 |
| 4,072,543 | 2/1978 | Coldren et al. | 148/12 F |
| 4,088,511 | 5/1978 | Rowney | 148/12 F |
| 4,184,898 | 1/1980 | Ouchi et al. | 148/12.4 |
| 4,285,741 | 8/1981 | Furukawa et al. | 148/12 D |
| 4,314,862 | 2/1982 | Sudo et al. | 148/12 F |
| 4,336,080 | 6/1982 | Nakaoka et al. | 148/12.4 |
| 4,388,122 | 6/1983 | Sudo et al. | 148/12.4 |

FOREIGN PATENT DOCUMENTS

| | | | |
|---|---|---|---|
| 53-119219 | 10/1978 | Japan | 148/12 F |
| 54-47818 | 4/1979 | Japan | 148/12 C |
| 54-114425 | 9/1979 | Japan | 148/12 F |
| 54-131524 | 10/1979 | Japan | 148/12 F |
| 55-158226 | 12/1980 | Japan | 148/12.4 |

OTHER PUBLICATIONS

Rigsbee et al., "Structure-Processing and Structure--Property Relationships in Commercially Processed Dual-Phase Steels", Conf. Proceedings New Orleans, La., Feb. 19-21, 1979, pp. 304-329.

*Primary Examiner*—Peter K. Skiff
*Attorney, Agent, or Firm*—Oblon, Fisher, Spivak, McClelland & Maier

[57] ABSTRACT

A cold-rolled high strength steel plate with excellent formability and baking hardenability, has the composition (% by weight) 0.2-0.15% of C, 0.02-0.7% of Mn, 0.01-0.1% of Al and 0.002-0.01% of N, optionally at least one element selected from the group consisting of 0.01-0.8% of Si, 0.01-0.1% of P, 0.0002-0.005% of B and 0.01-0.5% of V, and a microstructure comprising ferrite containing 2-30% of bainite and less than 8% of martensite.

The steel plate is produced by hot and cold rolling steel of the defined composition followed by rapidly heating to a temperature between the $Ac_1$ and $Ac_3$ transformation points, holding at this temperature for less than 5 minutes, and quenching to a temperature below 500° C. at a cooling rate between 50° and 500° C./sec.

17 Claims, 3 Drawing Figures

COLD-ROLLED HIGH STRENGTH STEEL PLATE WITH COMPOSITE STEEL STRUCTURE OF HIGH R-VALUE AND METHOD FOR PRODUCING SAME

BACKGROUND OF THE INVENTION

1. Field of the Invention

This invention relates to a cold-rolled high strength steel plate of a composite or multi-phase steel structure having a high $\bar{r}$-value to ensure excellent deep drawability and baking hardenability, and to a method for producing such steel plates.

2. Description of the Prior Art

For the purpose of improving the gasoline mileage and safety of motor vehicles, attempts have been made for several years to use cold-rolled high strength steel sheet for the exterior and interior panels of motor vehicles. These attempts, however, mostly failed to reach the stage of application on an industrial scale due to problems such as clefts, wrinkles or other surface defects arising during forming, forming difficulty caused by large spring-back forces, or difficulty of spot welding. Recently, steel sheet with high formability such as Al-killed steel containing phosphorous, and the ferrite + martensite steel (the so-called "dual phase steel", "D.P. steel") have been used in some applications. With regard to D.P. steel, it has not yet been adapted for industrial applications in spite of its advantages, i.e., high strength, low yield ratio and baking hardenability (B.H.). However, D.P. steel has a serious problem in that the introduction of martensite or a low temperature transformation structure hereinafter referred to as second phase in ferrite causes a material drop in the value of $\bar{r}$, an index of deep drawability, making it difficult to obtain an $\bar{r}$-value higher than 1.5, that is, to achieve good deep drawability which is an important factor in formability. Furthermore, the strength of D.P. steel is too high to produce a steel in the strength class 35–40 kg/mm$^2$ reproducibly.

Hence a need has continued to exist for a dual phase steel having a high $\bar{r}$-value, in order to provide the steel with good deep drawing properties and the capability of being hardened by baking.

SUMMARY OF THE INVENTION

Accordingly, it is an object of this invention to provide a multi-phase steel having a high $\bar{r}$-value.

A further object is to provide a multi-phase steel which has a tensile strength greater than 35 kg/mm$^2$.

A furthr object is to provide a steel having good deep drawing properties, good stretch flangeability, and baking hardenability.

Further objects of the invention will become apparent from the description of the invention which follows.

With the foregoing in view, the present inventors have conducted fundamental studies and extensive experiments on steels of composite structure in general, without concentrating exclusively on the ferrite + martensite steel structure, and as a result have found that it is essential to the improvement of the $\bar{r}$-value to make the second phase bainite (with some martensite allowed) and that the resulting composite steel structure has excellent stretch flangeability and baking hardenability.

The objects of the invention are attained by a high strength cold rolled steel plate or sheet having the composition (% by weight):

C: 0.02–0.15
Mn: 0.02–0.7
Al: 0.01–0.1
N: 0.002–0.01 balance iron and inevitable impurities, having a microstructure comprising ferrite and bainite, wherein the area ratio of bainite is in the range of 2–30% and the $\bar{r}$-value of said steel is greater than 1.4.

According to the present invention, there is also provided a method for producing a cold-rolled high strength steel plate of the type defined above, which comprises cold-rolling a steel of the above-mentioned chemical composition, optionally subjecting the cold-rolled steel to a batch type annealing, heating the steel at an average heating rate greater than 5° C./sec to a temperature range between the transformation points $Ac_1$ and $Ac_3$, holding in that temperature range for a time period shorter than 5 minutes, and quenching the material at an average cooling speed of 50°–500° C./sec to a temperature lower than 500° C., thereby forming a ferrite structure containing 2–30% of bainite and, if martensite is also present, less than 8% of martensite.

When cooling the steel material from the holding temperature range between the transformation points $Ac_1$ and $Ac_3$ according to the method of the present invention, it is preferred to cool the material slowly at an average cooling speed of 5°–40° C./S until a temperature level approximately equal to the transformation point $Ac_1$ is reached.

BRIEF DESCRIPTION OF THE DRAWINGS

The above and other objects, features and advantages of the present invention will become apparent from the following description, taken in conjunction with the accompanying drawings.

DETAILED DESCRIPTION OF THE INVENTION AND PREFERRED EMBODIMENTS

In investigating solutions for the problems solved by the present invention which relates to the cold-rolled high strength steel plate, the area ratio of bainite in the second phase must be greater than 2% since otherwise it becomes difficult to secure the properties inherent to the dual phase steel, such as high strength, low yield ratio and baking hardenability. If the area ratio of the bainite in the second phase exceeds 30%, however, a considerable degradation of the $\bar{r}$-value occurs and difficulty is encountered in maintaining a high $\bar{r}$-value. In addition, the Charpy V-notch transition temperature increases markedly. Therefore, the area ratio of the bainite in the second phase should be limited to 2–30%, and preferably to the range 5–20%. The term "second phase " as herein used includes martensite and bainite. The term "bainite" includes bainite which contains bainitic ferrite and/or carbide, and the term "martensite" includes partly retained austenite. The ferrite is preferably polygonal ferrite.

Figure 1:
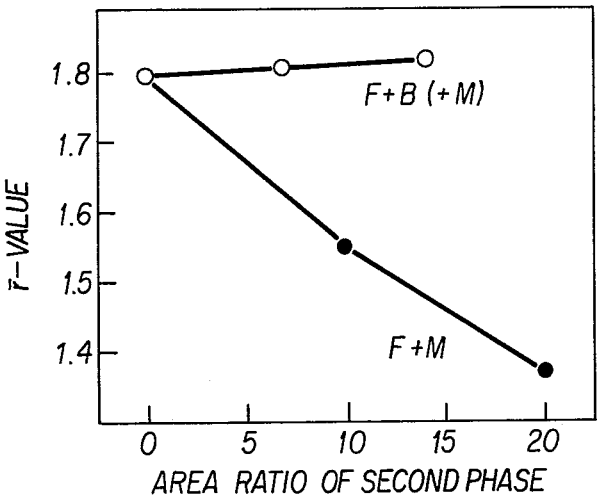
FIG. 1 is a diagram of the $\bar{r}$-value versus the area ratio of the second phase in ferrite+martensite steel and ferrite+bainite (+martensite) steel, obtained by employing various patterns of heat treatment in continuous annealing of low carbon Al-killed steel plates.
Figure 2:
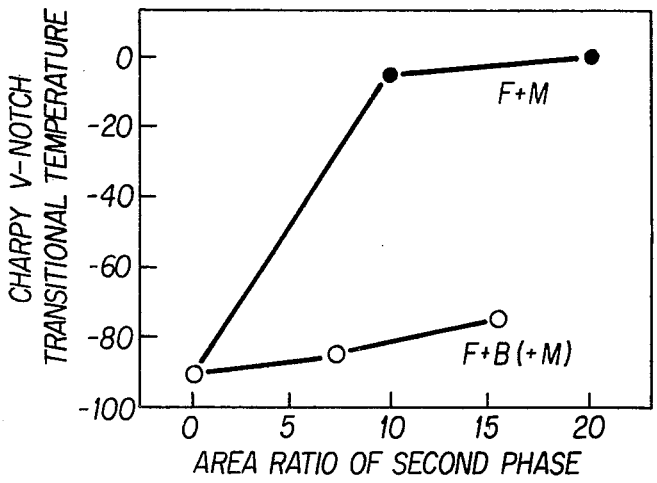
FIG. 2 is a diagram of the area ratio of the second phase versus the Charpy V-notch transition temperature after deep drawing (drawing ratio: 2)

In the cold-rolled high strength steel plate according to the present invention, it is important to introduce an appropriate amount of bainite in the second phase. More specifically, reference is made to FIG. 1 which shows the relation between the area ratio of the second phase and the $\bar{r}$-value in two different types of dual phase steel structures, one having martensite introduced thereinto as a second phase and the other one having bainite (partly containing martensite). As seen in FIG. 1, the conventional dual phase steel with a second phase of martensite shows marked deterioration in the $\bar{r}$-value with increasing amounts of martensite. In contrast, the ferrite+bainite steel which incorporates bainite as a second phase is free of deterioration in the $\bar{r}$-value caused by the introduction of the second phase, and shows a value comparable to that of 700° C.-annealed ordinary ferrite (+pearlite) steel, with formability far exceeding the value of $\bar{r}>1.4$. The relations between the Charpy V-notch transition temperature and the area ratio of the second phase after deep drawing (drawing ratio: 2) of the dual phase steel structure of FIG. 1 are shown in the diagram of FIG. 2. As seen therefrom, even if the area ratio of the second phase is increased, the transition temperature of the ferrite+bainite steel after the forming operation is maintained at a more appropriate value as compared with the ferrite+martensite steel. In the cold-rolled high strength steel plate according to the present invention, the area ratio of the bainite phase is greater than 2% since otherwise it becomes difficult to secure the properties inherent to the dual phase steel structure, i.e., high strength, low yield ratio and baking hardenability. The area ratio of bainite, however, should not exceed to 30%, because an area ratio greater than 30% will be reflected in a deterioration of the $\bar{r}$-value and a considerable increase of the Charpy V-notch transition temperature. Preferably, the area ratio of bainite should be 5–20%. The cold-rolled high strength steel plate of the present invention permits the second phase to contain martensite in a small proportion in addition to bainite. The introduction of martensite is desirable from the standpoint of improving the yield ratio and elongation but it should not be permitted in a large proportion since it tends to cause deterioration in the $\bar{r}$-value as mentioned hereinbefore. Thus, the area ratio of martensite should be limited to not greater than 8%, and preferably to an amount smaller than that of bainite. It is preferable that the martensite introduced should exist in such a condition that it is finely dispersed around the bainite and in direct contact with the ferrite base.

Turning now to the chemical composition of the cold-rolled high strength steel plate according to the invention, the element C should be present in amounts more than 0.02% in order to produce its effect of strengthening and improving the baking hardenability, to form martensite and to ensure a sound structure for spotwelded portions. However, an excessivley large C-content produces a decrease in the $\bar{r}$-value of and in the cold-workability and hardening of spot-welded portions; accordingly the upper limit should be 0.15%.

When especially high cold-workability is required, it is preferred to keep the C-content less than 0.07%.

The element Mn which is necessary for preventing hot shortness due to S and for obtaining the desired structure by increasing the hardenability should be present in amounts greater than 0.02%. However, since an excessive Mn-content hinders development of the aggregate structure <111> and lowers the $\bar{r}$-value, the upper limit should be 0.7%. When an especially high $\bar{r}$-value is required, the Mn-content should be preferably be held lower than 0.4%.

The element Al which is necessary as a deoxidizing element also has the effect of forming recrystallized aggregate structure of good formability during the stage of batch annealing, if used, by combining with N, and to produce this effect it should be present in amounts greater than 0.01%. However, an excessive Al-content increases the number of inclusions, so that it should be limited to a maximum of 0.1%, preferably to 0.01–0.06%.

The element N which contributes to the formation of recrystallized aggregate structure as AlN by bonding with Al as mentioned above to improve the $\bar{r}$-value, should be present in amounts greater than 0.002%, preferably greater than 0.003%. However, it should be limited to a maximum of 0.01% since its effect becomes saturated and a greater N-content causes difficulty in the melting stage.

In addition to the above-mentioned components, the steel plate of the present invention may contain a suitable amounts of at least one element selected from the group consisting of Si, P, B or V. The elements Si and P contribute to the stabilization of austenite by accelerating the concentration of C in the austenite, thus facilitating the formation of bainite, and to imparting high strength and high ductility. The proportions of Si and P, if present, should be in the ranges of 0.01–0.8% and 0.01–0.1%, respectively. Si is also an element which suppresses deteriorations in the $\bar{r}$-value even when martensite is introduced into ferrite. In order to secure these effects, the Si-content when present should be greater than 0.1%. It is preferably limited to a maximum of 0.5% as an excessive Si-content tends to increase strength and degrade the $\bar{r}$-value.

The element P is preferably present in amounts greater than 0.035% in order to strengthen the steel and to improve its drawability, but it should be limited to a maximum of 0.10%, as an excessive P-content rather would adversely affect the drawability and workability. The element B serves to prevent aging by fixing N, to facilitate the bainite transformation and to enhance the $\bar{r}$-value by accelerating the growth of recrystallized grains after continuous annealing; accordingly, it should present in the range of 0.0002–0.005%. The element V acts as a precipitation hardening element and contributes to the production of bainite (+martensite), in addition to its effect of preventing softening of the heat affected zone after spot welding. In order to secure these effects, the proportion of V should be in the range of 0.01–0.5%. With regard to the elements S and O which are harmful, it is desirable to hold the content of S less than 0.02% and the content of O to less than 0.05%, preferably less than 0.015%.

In addition to the above-mentioned components, the steel plate according to the present invention may contain a suitable amount of a rare earth metal and/or Ca. For shape control of the sulfides, the steel may contain at least one element selected from the group consisting of 0.005–0.1% of a rare earth metal and 0.0005–0.01% of Ca.

The production of the cold-rolled high strength steel plate by the process of this invention will now be explained with reference to the diagram of FIG. 3.

Figure 3:
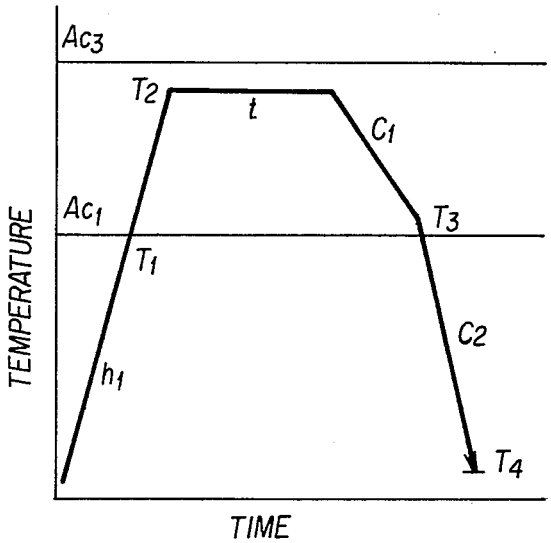
FIG. 3 is a diagram showing the conditions of heat treatment according to the present invention.

In FIG. 3, a cold-rolled steel plate of a predetermined chemical composition is rapidly heated at a heating rate $h_1$ to a temperature $T_2$ in the dual $(\alpha+\gamma)$ phase range between transformation points $Ac_1$ and $Ac_3$, and held at the temperature $T_2$ for a time t. This heating step is intended to improve the $\bar{r}$-value by forming a <111> recrystallized texture. The heating rate $h_1$ should preferably be greater than 5° C./sec, because at lower heating speeds, resolving of cementite takes place, resulting in that carbon in solid solution prevents formation of the <111> recrystallized texture. The temperature $T_2$ should be between the transformation points $Ac_1$ and $Ac_3$ and the steel should be held at $T_2$ for a time period shorter than 5 minutes in order to produce austenite at this stage in preparation for the formation of the dual structure. The temperature $T_2$ is preferably in the upper part of the dual phase $(\alpha+\gamma)$ range. In the step of heating up to the temperature $T_2$, it is desirable to use initial rapid heating at the heating rate $h_1$ up to the temperature $T_1$ which is higher than the recrystallizing temperature but lower than the holding temperature $T_2$, and then to heat slowly at a heating rate less than 10° C./sec between $T_1$ and $T_2$ for the purpose of obtaining a more appropriate recrystallized texture. The slow heating makes it possible to grow recrystallized <111> grains selectively.

After holding the steel at temperature $T_2$ for the predetermined time period t, the work is slowly cooled at an average cooling rate $C_1$ to a temperature $T_3$ in the range between the temperature $T_2$ and the transformation point $Ar_1$. In this stage, carbon in solid solution in ferrite is concentrated in the austenite and stabilizes the latter, while the ductility of the steel is improved because the ferrite contains a reduced amount of carbon in solid solution. Furthermore, since this is a preparatory step for the formation of the second phase in the desired proportion, the cooling speed $C_1$ should be slow, preferably in the range 5°–40° C./sec. Alternatively, the slow cooling may be dispensed with by having $T_2=T_3$, namely by prolonging the time t over which the temperature $T_2$ is held.

The slow cooling is followed by quenching from temperature $T_3$ (or $T_2$) to temperature $T_4$. Since this is a step for the transformation of the high-carbon austenite into bainite (+ martensite), it requires a cooling rate higher than $C_1$, but the average cooling rate in this step should be 50°–500° C./sec as a too high cooling speed will result in production of a large amount of martensite. The temperature $T_4$ must be lower than 500° C. for the bainite transformation.

The quenching is followed by an over-aging treatment if necessary. In the quenching stage, there may be arbitrarily employed a water-cooled roll system, a boiling water showering or immersing system or a heat pipe system, whichever is suitable.

Having generally described the invention, a more complete understanding can be obtained by reference to certain specific examples, which are provided herein for purposes of illustration only and are not intended to be limiting unless otherwise specified. EXAMPLES 1

The specimens shown in Table 1 were melted in vacuum melter and, after rough rolling into 30 mm thick slabs, reduced into 2.8 mm thick plates by 3-pass hot rolling. The plates were then cold-rolled into 0.8 mm thick cold-rolled sheet, while subjecting the cold-rolled sheet to continuous annealing under the conditions shown in Table 2 to obtain steel sheet of different microstructures. Table 3 shows the results of the observation of microstructures of the thus obtained steel sheet along with the results of measurement of the mechanical properties thereof.

TABLE 1

| Specimen No. | Chemical Composition (wt %) C | Si | Mn | P | S | Al | B |
|---|---|---|---|---|---|---|---|
| 1 | 0.05 | 0.01 | 0.22 | 0.015 | 0.012 | 0.04 | — |
| 2 | 0.04 | 0.20 | 0.16 | 0.017 | 0.008 | 0.02 | 0.003 |
| 3 | 0.05 | 0.01 | 0.35 | 0.075 | 0.005 | 0.03 | — |
| 4 | 0.04 | 0.01 | 0.21 | 0.015 | 0.010 | — | — |
| 5 | 0.04 | 0.01 | 0.21 | 0.015 | 0.010 | — | — |
| 6 | 0.04 | 0.01 | 0.21 | 0.015 | 0.010 | — | — |
| 7 | 0.04 | 0.01 | 0.21 | 0.015 | 0.010 | — | — |
| 8 | 0.05 | 0.01 | 1.0 | 0.014 | 0.006 | 0.03 | — |
| 9 | 0.14 | 0.01 | 0.60 | 0.015 | 0.020 | — | — |

TABLE 2

| Specimen No. | Conditions of Continuous Annealing* $h_1$ (°C./sec) | $T_1$ (°C.) | $h_2$ (°C./sec) | $T_2$ (°C.) | t (min) | $C_1$ (°C./sec) | $T_3$ (°C.) (°C./sec) | $C_2$ (°C.) | $T_4$ Remarks | |
|---|---|---|---|---|---|---|---|---|---|---|
| 1 | 20 | — | — | 850 | 2 | 20 | 760 | 200 | 250 | Invention |
| 2 | " | — | — | " | " | " | " | " | " | " |
| 3 | " | — | — | " | " | " | " | " | " | " |
| 4 | " | — | — | " | " | " | " | " | " | " |
| 5 | " | 680 | 15 | " | " | " | " | " | " | " |
| 6 | " | — | — | 800 | " | — | 800 | " | 300 | " |
| 7 | " | — | — | 800 | 2 | 20 | 800 | 2000 | R.T. | Comparative |
| 8 | " | — | — | 850 | " | " | 760 | 200 | 250 | " |
| 9 | " | — | — | " | " | " | " | " | " | " |

*Followed by an over-aging treatment of 300° C. × 2 minutes.

TABLE 3

| Specimen No. | Mechanical Properties & Microstructures Yield stress (kg/mm²) | Yield point elongation (%) | Tensile strength (kg/mm²) | Yield ratio | $\bar{r}$ | Total elongation (%) | Hole expanding limit (%) | * ΔσyBH (kg/mm²) | Microstructure** | Remarks |
|---|---|---|---|---|---|---|---|---|---|---|
| 1 | 22.8 | 0 | 36.8 | 0.62 | 1.72 | 41.8 | ≧270 | 5.3 | F + 11% B + 2% M | Invention |
| 2 | 25.3 | 0 | 38.9 | 0.65 | 1.71 | 41.1 | " | 5.5 | F + 10% B + 2% M | " |
| 3 | 22.9 | 0 | 49.4 | 0.58 | 1.68 | 39.5 | " | 5.6 | F + 10% B + 3% M | " |
| 4 | 22.1 | 0 | 36.2 | 0.61 | 1.74 | 41.4 | " | 7.9 | F + 10% B + 2% M | " |
| 5 | 22.1 | 0 | 36.3 | 0.61 | 1.78 | 41.3 | " | 7.8 | F + 10% B + 2% M | " |

TABLE 3-continued

| Specimen No. | Yield stress (kg/mm²) | Yield point elongation (%) | Tensile strength (kg/mm²) | Mechanical Properties & Microstructures: Yield ratio | $\bar{r}$ | Total elongation (%) | Hole expanding limit (%) | * ΔσyBH (kg/mm²) | Microstructure** | Remarks |
|---|---|---|---|---|---|---|---|---|---|---|
| 6 | 22.3 | 0 | 35.9 | 0.62 | 1.79 | 41.2 | " | 7.3 | F + 12% B | " |
| 7 | 25.4 | 0 | 37.4 | 0.68 | 1.41 | 41.0 | 210 | 8.7 | F + 14% M | Comparative |
| 8 | 28.2 | 0 | 49.5 | 0.57 | 1.15 | 31.3 | 150 | 5.6 | F + 5% B + 10% M | " |
| 9 | 29.8 | 0 | 54.2 | 0.55 | 0.90 | 28.6 | 140 | 7.6 | F + 3% B + 15% M | " |

All tested by JIS No. 13 test piece after 1% skin pass.
*BH: Increase in yield stress due to aging when aged 170° C. × 20 min. after 2% tensile straining.
**F: Ferrite
B: Bainite
M: Martensite As seen in Table 3, the specimens 1–5 representing the steel plate according to the present invention are all have an $\bar{r}$-value greater than 1.5 and are satisfactory in stretch flangeability (hole expanding limit), with baking hardenability higher than 5 kg/mm². It has also been confirmed that the steel according to the invention has high spot-weldability, fatigue strength and tenacity.

EXAMPLE 2

The specimens shown in Table 4 were melted in a vacuum melter and, after rough rolling into 30 mm thick slabs, rolled into 2.8 mm thick plates by 3-pass hot-rolling. The plates were then cold-rolled into 0.8 mm thick cold-rolled sheet, while subjecting the cold-rolled sheet to batch annealing under the condition of 700° C.×3 hrs, and then continuous annealing under the conditions shown in Table 5 to obtain steel sheet of different structures. Table 6 shows the results of the observation of the microstructures of the thus obtained steel plates along with the results of measurement of mechanical properties thereof.

TABLE 4

| Specimen No. | Chemical Compositions (wt %): C | Si | Mn | P | S | Al | N | Others | Remarks |
|---|---|---|---|---|---|---|---|---|---|
| 1 | 0.06 | — | 0.45 | 0.080 | 0.15 | 0.050 | 0.0050 | — | Invention |
| 2 | 0.06 | 0.30 | 0.45 | 0.082 | 0.014 | 0.050 | 0.005 | — | |
| 3 | 0.04 | — | 0.40 | 0.005 | 0.005 | 0.045 | 0.0045 | — | |
| 4 | 0.05 | — | 0.45 | 0.055 | 0.005 | 0.050 | 0.0055 | B 0.0025 | |
| 5 | 0.05 | — | 0.45 | 0.055 | 0.007 | 0.045 | 0.0065 | V 0.010 | |
| 6 | 0.05 | — | 0.45 | 0.055 | 0.005 | 0.050 | 0.0055 | B 0.00025 | |
| 7 | 0.06 | — | 0.45 | 0.080 | 0.015 | 0.050 | 0.0050 | — | Comparative Example |
| 8 | 0.06 | 0.01 | 1.20 | 0.014 | 0.006 | 0.030 | 0.0045 | — | |
| 9 | 0.06 | 0.2 | 0.45 | 0.25 | 0.006 | 0.050 | 0.0060 | — | |
| 10 | 0.20 | 0.2 | 0.45 | 0.060 | 0.005 | 0.040 | 0.0045 | — | |

TABLE 5

| Specimen No. | Conditions of Continuous Annealing*: $h_1$ (°C./sec) | $T_2$ (°C.) | t (min) | $C_1$ (°C./sec) | $T_3$ (°C.) | $C_2$ (°C./sec) | $T_4$ (°C.) | Remarks |
|---|---|---|---|---|---|---|---|---|
| 1 | 20 | 850 | 1 | 20 | 760 | 100 | 250 | Invention |
| 2 | " | " | " | " | " | " | " | |
| 3 | " | " | " | " | " | " | " | |
| 4 | " | " | " | " | " | " | " | |
| 5 | " | 760 | " | " | " | " | " | |
| 6 | " | 820 | " | — | 820 | " | 300 | |
| 7 | " | 850 | " | " | 760 | 2000 | R.T | Comparative Example |
| 8 | " | " | " | " | " | 100 | 250 | |
| 9 | " | " | " | " | " | " | " | |
| 10 | " | " | " | " | " | " | " | |

*Followed by an over-aging treatment of 300° C. × 2 minutes.

TABLE 6

| Specimen No. | Yield stress (kg/mm²) | Tensile strength (kg/mm²) | Yield ratio | Mechanical Properties & Microstructures: Total elongation (%) | $\bar{r}$ | Hole expanding limit (%) | ΔσyBH* (kg/mm²) | Micro-** structure | Remarks |
|---|---|---|---|---|---|---|---|---|---|
| 1 | 29.3 | 48.8 | 0.60 | 30.9 | 1.76 | ≧270 | 5.0 | F + 13% B + 3% M | Invention |
| 2 | 31.6 | 52.7 | 0.60 | 28.9 | 1.77 | " | 5.2 | F + 11% B + 4% M | |
| 3 | 23.5 | 41.3 | 0.57 | 36.3 | 1.78 | " | 5.3 | F + 10% B + 1% M | |
| 4 | 28.6 | 48.4 | 0.59 | 30.5 | 1.75 | " | 7.2 | F + 12% B + 2% M | |
| 5 | 33.3 | 51.2 | 0.65 | 28.7 | 1.65 | " | 7.0 | F + 14% B + 2% M | |
| 6 | 28.3 | 47.6 | 0.64 | 30.3 | 1.80 | " | 6.9 | F + 13% B | |
| 7 | 36.2 | 52.5 | 0.69 | 28.9 | 1.40 | 190 | 8.2 | F + 13% M | Comparative Example |
| 8 | 35.8 | 60.3 | 0.61 | 24.5 | 1.10 | 140 | 5.4 | F + 10% B + 10% M | |
| 9 | 34.2 | 57.9 | 0.59 | 25.7 | 1.55 | 180 | 5.2 | F + 10% B + 6% M | |

TABLE 6-continued

| Specimen No. | Yield stress (kg/mm²) | Tensile strength (kg/mm²) | Yield ratio | Total elongation (%) | $\bar{r}$ | Hole expanding limit (%) | ΔσyBH* (kg/mm²) | Micro-** structure | Remarks |
|---|---|---|---|---|---|---|---|---|---|
| | | | | Mechanical Properties & Microstructures | | | | | |
| 10 | 35.1 | 61.6 | 0.57 | 24.4 | 0.92 | 120 | 5.2 | F + 5% B + 15% M | |

All tested by JIS No. 13 test piece after 1% skin pass.
*BH: Increase in yield stress due to aging when aged 170° C. × 20 min. after 2% tensile straining
**F: Ferrite
B: Bainite
M: Martensite As seen in Table 6, the specimens 1–6 representing the steel plate according to the present invention all have an $\bar{r}$-value greater than 1.5 and are satisfactory in stretch flangeability (hole expanding limit), with baking hardenability higher than 5 kg/mm. It has also been confirmed that the steel according to the invention has high spot weldability, fatigue strength and elongation.

Having now fully described the invention, it will be apparent to one of ordinary skill in the art that many changes and modifications can be made thereto without departing from the spirit or scope of the invention as set forth herein.

What is claimed as new and desired to be secured by letters patent of the United States is:

1. A high strength cold rolled steel plate or sheet consisting essentially of:
carbon: 0.02–0.15% by weight
manganese: 0.02–0.7% by weight
aluminum: 0.01–0.1% by weight
nitrogen: 0.002–0.01% by weight
balance iron and inevitable impurities, said steel having a microstructure comprising ferrite and bainite, and possibly subordinate martensite, wherein the area ratio of said bainite is 2–30%, the area ratio of said martensite is not greater than 8%, and the area ratio of the martensite is less than that of the bainite, said steel having an $\bar{r}$-value greater than 1.5.

2. The steel plate or sheet of claim 1, additionally comprising at least one element selected from the group consisting of:
phosphorus: 0.01–0.1% by weight
silicon: 0.01–0.8% by weight
boron: 0.0002–0.005% by weight
vanadium: 0.01–0.5% by weight.

3. The steel plate or sheet of claim 1 wherein said steel additionally comprises at least one element selected from the group consisting of:
calcium: 0.0005–0.01% by weight
rare earth metals: 0.005–0.1% by weight.

4. The steel plate of claim 1 wherein the carbon content is 0.02–0.07% by weight.

5. The steel plate of claim 1 wherein the manganese content is 0.02–0.4% by weight.

6. The steel plate of claim 1 wherein the aluminum content is 0.01–0.06% by weight.

7. The steel plate or sheet of claim 1, wherein said steel has an $\bar{r}$-value greater than 1.68.

8. The steel plate or sheet of claim 7, additionally comprising at least one element selected from the group consisting of:
phosphorus: 0.01–0.1% by weight
silicon: 0.01–0.8% by weight
boron: 0.0002–0.005% by weight
vanadium: 0.01–0.5% by weight.

9. The steel sheet of claim 7, wherein said steel additionally comprises at least one element selected from the group consisting of:
calcium: 0.0005–0.01% by weight
rare earth metals: 0.005–0.1% by weight.

10. The steel plate or sheet of claim 1, wherein the area ratio of said bainite is in the range of 5–20%.

11. A process for producing high strength cold-rolled steel plate or sheet comprising:
(a) hot rolling a steel consisting essentially of:
carbon: 0.02–0.15% by weight
manganese: 0.02–0.7% by weight
aluminum: 0.01–0.1% by weight
nitrogen: 0.002–0.01% by weight
balance iron and inevitable impurities;
(b) cold rolling said hot rolled steel plate or sheet;
(c) batch annealing said cold rolled steel plate or sheet;
(d) heating said annealed steel plate or sheet to a temperature range between the $Ac_1$ transformation point and the $Ac_3$ transformation point at an average heating rate greater than 5° C./sec;
(e) maintaining said steel within said temperature range for a period of time shorter than 5 minutes;
(f) quenching said steel to a temperature below 500° C. at an average cooling rate between 50° and 500° C./sec, thereby producing a steel having a dual-phase microstructure comprising ferrite and bainite, wherein the area ratio of any bainite is the range of 2 to 30%, the area ratio of any martensite is not greater than 8%, and the area ratio of the martensite is less than that of the bainite; said steel having an $\bar{r}$-value greater than 1.5.

12. A process for producing high strength cold-rolled steel plate or sheet comprising:
(a) hot rolling a steel consisting essentially of:
carbon: 0.02–0.15% by weight
manganese: 0.02–0.7% by weight
aluminum: 0.01–0.1% by weight
nitrogen: 0.002–0.01% by weight
balance iron and inevitable impurities:
(b) cold rolling said hot rolled steel plate or sheet;
(c) heating said cold rolled steel plate or sheet to a temperature range between the $Ac_1$ transformation point and the $Ac_3$ transformation point at an average heating rate greater than 5° C./sec;
(d) maintaining said steel within said temperature range for a period of time shorter than 5 minutes;
(e) quenching said steel to a temperature below 500° C. at an average cooling rate between 50° and 500° C./sec, thereby producing a steel having a dual-phase microstructure comprising ferrite and bainite, wherein the area ratio of any bainite is the range of 2 to 30%, the area ratio of any martensite is not greater than 8%, and the area ratio of the martensite is less than that of the bainite; said steel having an $\bar{r}$-value greater than 1.5.

13. The process of claim 12, wherein in step (c) the steel is rapidly heated to a temperature higher than the recrystallizing temperature, but lower that the temperature at which it is to be held, said heating being conducted at a rate greater than 5° C./sec, and thereafter slowly heating said steel to a temperature between the $Ac_1$ transformation point and the $Ac_3$ transformation point at an average heating rate less than 10° C./sec.

14. The process of any one of claims 11–13 wherein, in the step of cooling said steel from the holding temperature between the $Ac_1$ transformation point and the $Ac_3$ transformation point, said steel is slowly cooled to a temperature lower than the holding temperature but higher than the $Ac_1$ transformation point at an average cooling rate of 5°–40° C./sec, and thereafter quenched to a temperature below 500° C. at an average cooling rate of 50° to 500° C./sec.

15. The process of claim 11 or claim 12, wherein the area ratio of bainite is in the range of 5 to 20% and the $\bar{r}$-value is greater than 1.5.

16. The process of claim 11 or claim 12 wherein said steel additionally comprises containing at least one element selected from the group consisting of:

phosphorus: 0.01–0.1% by weight
silicon: 0.01–0.08% by weight
boron: 0.0002–0.005% by weight
vanadium: 0.01–0.5% by weight.

17. The process of claim 11 or claim 12 wherein the steel additionally comprises at least one element selected from the group consisting of:

calcium: 0.0005–0.01% by weight
rare earth metals: 0.005–0.1% by weight.

* * * * *

UNITED STATES PATENT AND TRADEMARK OFFICE

CERTIFICATE OF CORRECTION

PATENT NO. : 4,426,235

DATED : JANUARY 17, 1984

INVENTOR(S) : MASATOSHI SUDO ET AL

It is certified that error appears in the above-identified patent and that said Letters Patent is hereby corrected as shown below:

| COL. | LINE | |
|---|---|---|
| -- | 3 | In the Abstract, Change "0.2" to --0.02--. |
| 1 | 54 | Change "furthr" to --further--. |
| 4 | 5 | Delete "be". |
| 6 | -- | Table 2, Please rewrite the legends for the four right hand columns, from left to right, as follows: |
| | | Change "$T_3$" to --$T_3$--. |
| | | (°C) (°C) |
| | | (°C/sec) |
| | | Change "$C_2$" to --$C_2$--. |
| | | (°C) (°C/sec) |
| | | Change "$T_4$" to --$T_4$--. |
| | | Remarks (°C) |
| | | Above the last column, insert --Remarks--. |
| 9 | 54 | After "plate", each occurrence, insert --or sheet--. |
| 9 | 56 | |
| 9 | 58 | |

UNITED STATES PATENT AND TRADEMARK OFFICE

CERTIFICATE OF CORRECTION

PATENT NO. : 4,426,235

DATED : JANUARY 17, 1984

INVENTOR(S) : MASATOSHI SUDO ET AL

It is certified that error appears in the above-identified patent and that said Letters Patent is hereby corrected as shown below:

| COL. | LINE | |
|---|---|---|
| 12 | 5 | Change "1.5" to --1.68--. |

Signed and Sealed this

*Thirtieth* Day of *October 1984*

[SEAL]

*Attest:*

GERALD J. MOSSINGHOFF

*Attesting Officer*

*Commissioner of Patents and Trademarks*